US005450665A

United States Patent [19]

Madono et al.

[11] Patent Number: 5,450,665

[45] Date of Patent: Sep. 19, 1995

[54] METHOD FOR MANUFACTURING A HOLLOW CAMSHAFT HAVING OIL-FEEDING HOLES ON ITS CHILLED FACE

[75] Inventors: Osamu Madono, 5-22-3 Oto, Yono-shi, Saitama-ken; Minoru Kase; Tamotsu Nozawa, both of Kashiwazaki, all of Japan

[73] Assignees: Riken-Chuzo Corporation, Niigata; Osamu Madono, Saitama, both of Japan

[21] Appl. No.: 168,180

[22] Filed: Dec. 17, 1993

[30] Foreign Application Priority Data

Dec. 18, 1992 [JP] Japan ..... 4-339162
Dec. 8, 1993 [JP] Japan ..... 5-308272

[51] Int. Cl.[6] ..... B22D 29/00; B22D 15/00; B21K 1/06

[52] U.S. Cl. ..... 29/888.1; 29/527.6; 164/132

[58] Field of Search ..... 29/6.01, 527.5, 527.6, 29/888.08, 888.09, 888.1; 164/127, 132, 352; 74/567; 123/90.34

[56] References Cited

U.S. PATENT DOCUMENTS 3,689,986 9/1972 Takahashi et al. ..... 29/527.6
4,308,656 1/1982 Jenks ..... 164/14 X
4,644,912 2/1987 Umeha et al. ..... 29/888.1 X
4,829,642 5/1989 Thomas et al. ..... 29/527.6 X
4,832,107 5/1989 Hass et al. ..... 164/132 X
5,072,773 12/1991 Ruff et al. ..... 164/127
5,122,204 6/1992 McDonald ..... 164/127 X

FOREIGN PATENT DOCUMENTS 3330141 8/1983 Germany .
46-11849 3/1971 Japan ..... 74/567
140722 6/1987 Japan ..... 29/888.1
9305908 4/1993 WIPO ..... 29/888.1

OTHER PUBLICATIONS

Patent Abstracts of Japan, vol. 6, No. 167 (M-153), JP57081950, May 22, 1982, N. Takeshi, et al., "Manufacture of Cam Shaft".

Patent Abstracts of Japan, vol. 10, No. 21 (M-449) [2078], JP-60-179569, Jan. 28, 1986, S. Oosaki, et al., "Manufacturing Method of Cam Shaft".

*Primary Examiner*—Peter Dungba Vo
*Attorney, Agent, or Firm*—Leydig, Voit & Mayer

[57] ABSTRACT

A hollow camshaft for automotive engines, which is made of cast iron, and which has at least one as-cast oil-feeding hole on the chilled faces of cam members is disclosed. When a camshaft is cast, thin carbon rod cores are used as cores which are enveloped in casting. After removing the carbon rods by burning them, small as cast oil-feeding holes are left in cam members.

18 Claims, 3 Drawing Sheets

METHOD FOR MANUFACTURING A HOLLOW CAMSHAFT HAVING OIL-FEEDING HOLES ON ITS CHILLED FACE

The present invention concerns a hollow camshaft for internal-combustion engines such as automotive engines and a method for their manufacture.

Camshafts for internal-combustion engines and particularly automotive engines are in many cases made of cast iron. There are various methods of making such camshafts. Typical methods include the chilled method in which the faces of cam members required to have high hardness are transformed to white iron during casting and the post-casting surface hardening method. Axially-hollow camshafts have also been commercialized, not only to reduce weight but also to feed lubricant oil to cam members through holes.

As is well known, one key to improving the performance of automotive engines is the valve mechanism. Mobile valve systems, however, are prone to lubrication problems due to the complicated movements of the systems. Especially, contact between a cam nose and a mating tapper or rocker arm is almost a line contact, and an extremely large load in this location makes fluid lubrication of the sliding face difficult. At present, lubrication of the sliding face requires the use of ultra-high pressure additives in the struggle for wear prevention. As a result, frictional losses are large and burnin troubles such as pitching or scuffing cannot be totally eliminated.

In order to prevent the wear of camshafts, attempts have been made to increase the hardness of the cam face or improve lubrication. Conventional lubrication is either external or internal lubrication. In external lubrication, lubricant oil is introduced into cams from outside from an oil pool or through oil holes of a rocker arm or valve guide. In internal lubrication, oil is supplied to cams through oil holes fabricated in a hollow camshaft. The latter lubrication method using a hollow camshaft has advantages over the former. Conventional hollow camshafts, however, have not provided satisfactory lubrication because the location of oil holes has not be optimal.

The nose of a cam circumference is the location most susceptible to wear because it is subjected to high loads during valve opening. In addition, while rotating, the nose moves on the surface of a valve lifter. It is thus necessary to disperse frictional heat from the mobile sliding face and ensure a constant local supply of fresh lubricant oil containing an ultra-high pressure agent. The most effective way to accomplish this would be to form oil-feeding holes in cam noses and lubricate the sliding face by injecting oil perpendicularly. However, such hollow camshafts equipped with oil holes on cam noses have not been manufactured.

Oil holes bored in camshafts have all been limited to the base circle part of cams and have not been formed in the nose part because the high hardness of the nose part prevents drilling. If productivity is ignored, of course, it is possible to fabricate holes no matter how hard the material may be. However, such hole fabrication is prohibitive from a cost standpoint and is not suitable for mass-produced products such as automobiles. As a compromise, oil holes have been fabricated on the base circle that is not hardened. However, when oil is supplied through holes on the base circle, the oil is injected during valve closing and not synchronously with frictional heat generation on the sliding face. Such lubrication, therefore, is ineffective and results in substantial consumption of lubricant oil due to wasteful injection.

There have been remarkable improvements in mobile valve systems accompanying improvement of automotive engine performance. Overhead Cams (OHC), Hydraulic Lash Adjusters (HLA), and other systems have widely been used, and these systems have increased the performance required of cams. The need for wear resistance improvement has intensified so much that chill hardening of not only the nose but of the whole circumference of cams is now demanded. This has made the fabrication of oil holes in cams difficult even on the base circle.

SUMMARY OF THE INVENTION

An object of the present invention is to provide a hollow camshaft of cast iron exhibiting improved wear resistance and satisfactory lubrication.

Another object of the present invention is to provide a method for making a hollow camshaft of cast iron with improved wear resistance, which can provide satisfactory lubrication.

The present invention is based on a finding that such purposes can be achieved by providing small as-cast oil-holes on a chilled face, i.e., in the nose of cam members.

According to the present invention, a hollow camshaft made of cast iron has at least one as-cast oil-feeding hole on the chilled faces of cam members.

In another aspect, the present invention provides a method for making a hollow camshaft made of cast iron having as-cast oil-feeding holes on the chilled faces of cam members comprising the steps of setting chills in cam-forming cavities, the chills having thin carbon rods in positions corresponding to the locations of oil-feeding holes, placing a center core in the cavities to assemble a mold, executing casting using the mold to envelop the carbon rods, and then removing the carbon rods to leave as-cast oil-feeding holes.

An alternative method comprises the steps of inserting thin carbon rods into a center core, setting the center core in the cam-forming cavities to assemble a mold, the thin carbon rods being located in positions corresponding to the locations of oil-feeding holes, executing casting using the mold to envelop the carbon rods, and then removing the carbon rods to leave as-cast oil-feeding holes.

Another alternative method comprises the steps of inserting carbon rods through the walls of cam forming cavities of a mold, the positions of the carbon rods corresponding to the locations of oil-feeding holes, executing casting using the mold to envelop the carbon rods to form a solid cast having cam members, boring the center of the solid cast enveloping the carbon rods, surface-hardening the cam members, and then removing the enveloped carbon rods.

Thus, according to the present invention, a thin carbon rod is placed at a position corresponding to the location of an oil-feeding hole, and it serves as an additional core.

In a preferred embodiment of the present invention, the enveloped carbon rods are removed by mechanical means or by burning, e.g., by heating in an oxidizing atmosphere to burn the carbon rods, or by drilling or by pushing out the carbon rods. As-cast oil-feeding holes are left.

DESCRIPTION OF PREFERRED EMBODIMENTS

The present invention will be described with reference to the accompanying drawings.

Figure 1:
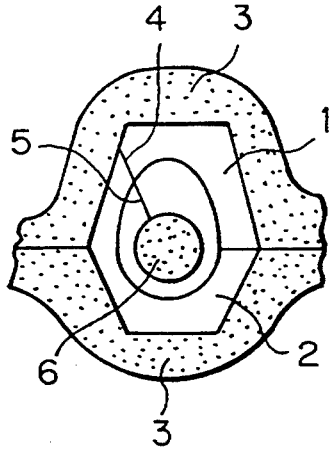
FIGS. 1 and 2 each show a cross section of a hollow chill casting mold for a camshaft.

In FIG. 1, carbon rods project through the cavities from the holes of the chills, the other ends of the carbon rods contact the center core, and the enveloped carbon rods are removed by heating them in an oxidizing atmosphere to burn the carbon rods.

Figure 2:
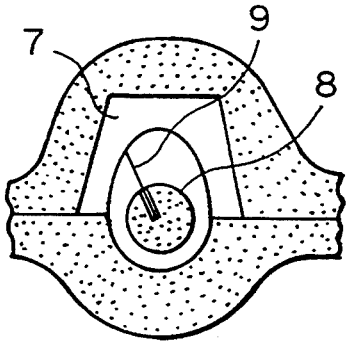
Figure 3:
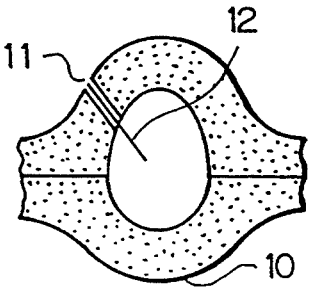
FIG. 3 shows a solid chill-less casting mold.

The carbon rods may project through the cavities from the center cores, as shown in FIG. 2, and in this case the other ends contact the chills. In the case of a solid cast, as shown in FIG. 3, the carbon rods are placed extending into the cavities to a suitable length.

In the present invention, when a camshaft is cast, carbon rod cores are enveloped so as to form oil-feeding holes in cam members. Holes feeding oil directly to the cam face must be small in diameter. Cores to make such small holes cannot be made of shell mold sand or similar materials because of their strength limitations. Ceramic cores such as quartz tubes have sufficient strength but are difficult to shake out and too hard to drill.

The present invention uses carbon rods as a core material for oil-feeding holes. As is well known, carbon is commercially available in the form of fibers and powders, and its shaped bodies excel in heat resistance and strength at elevated temperatures. In addition, carbon bodies are easy to form so that they may be extruded into shaped thin rods. The only shortcoming of carbon is its tendency to oxidize at elevated temperatures. The present invention takes advantage of this shortcoming in that carbon cores enveloped in a casting are removed through oxidation by heating them at elevated temperatures.

The carbon rods employed in the present invention can be commercially available rods of suitable dimensions (either thick or thin). There is no need for special techniques to make carbon rods used for the present invention. For accurate positioning in cam cavities, carbon rods are inserted through the holes formed in chills placed in cam cavities. In this way, even a thin rod core can be fastened at an exact location. Thus fastened, carbon rods are enveloped in casting in perfect condition without shifting or damage during casting.

Carbon rods may be inserted into a center core instead of chills. Alternatively, the carbon rods may be set in the main mold when chill casting is not used and cam faces are hardened after casting. Induction hardening or remelting by TIG are used for surface hardening of cam members subsequent to casting without chills, wherein enveloped carbon rods may not have to be removed before and may stay in place during surface hardening.

Surface hardening carried out after holes are fabricated on cam faces tends to cause cracks due to stress concentration or blocking of the holes. In contrast, holes filled with carbon rods according to the present invention cause neither cracks nor blocking.

In the present invention, as-cast carbon rods can be removed through oxidation by heating cast bodies in an oxidizing atmosphere at elevated temperatures. The higher the temperature, the faster the removal. Such oxidation can be performed at high temperatures because a chilled cast does not soften at temperatures below 600° C. Cast bodies quenched for surface hardening, however, soften at temperatures above 200° C., which necessitates removal of carbon rods by mechanical means such as drilling or extrusion.

Solid cast bodies undergo center boring prior to heat treatment. In this case, enveloped carbon rods are soft enough not to interfere with machining.

The method of making a hollow camshaft made of cast iron according to the present invention is further disclosed below.

Main casting molds for camshafts can be of various types such as green sand molds, $CO_2$ molds, shell molds, or fran molds, selection being made according to design and size. For a large number of cams, hardened cores such as shell molds are recommended for exact positioning of a correspondingly large number of chills and a resultant narrow spacing between chills.

Carbon core rods as thin as 0.5 mm in diameter can be enveloped in casting. Carbon rods are strong and tough yet easy to machine. Accordingly, it is an easy task to insert and fasten thin carbon rods in small holes of chills. The rods do not interfere with center boring, either.

The heating temperature and time required for oxidizing and removing carbon rods vary according to the diameter and depth of oil-feeding holes. For example, less than 2 hours of heating at 550° C. can totally remove carbon rods from holes 2 mm in diameter and 10 mm in depth. Such time and temperature are the same as the routine annealing conditions used for strain removal of cast bodies. In other words, removal of carbon rods does not entail additional heat treatment costs.

In order to remove the enveloped carbon rods by mechanical means, such as by drilling or extruding, a drilling bar or extruding bar having the same diameter as the carbon rods may be used. Since the carbon rods are softened at a temperature of 200° C. or higher when the surface hardening is carried out by quenching after casting, it is convenient to carry out drilling or extruding at such a high temperature.

Figure 4:
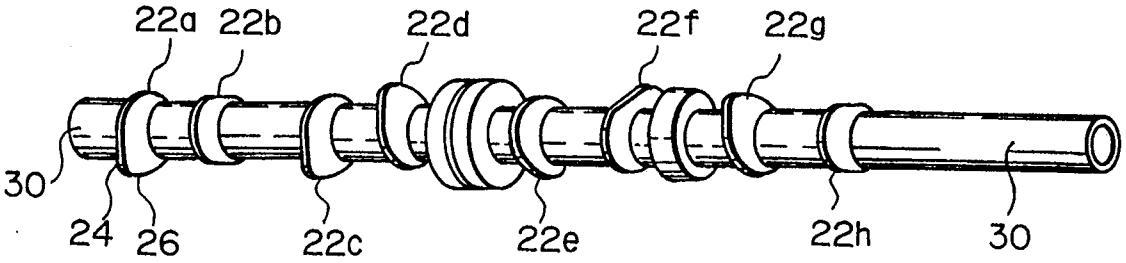
FIG. 4 is a perspective view of a hollow camshaft of the present invention.
Figure 5:
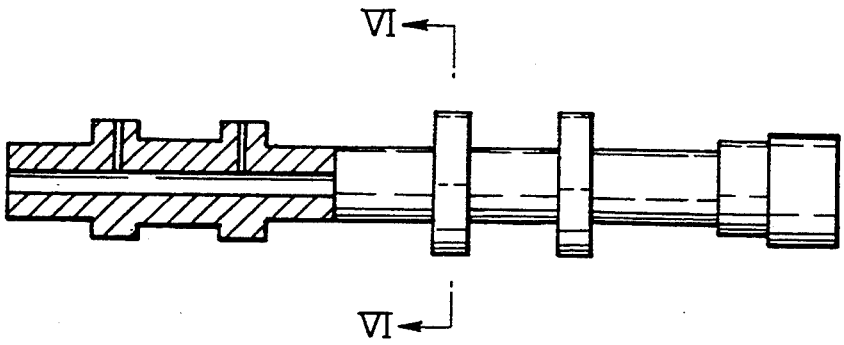
FIG. 5 is a partial sectional side view of another hollow camshaft of the present invention.
Figure 6:
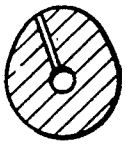
FIG. 6 is a sectional view taken along line VI—VI of FIG. 5.

FIG. 4 is a perspective view of a hollow camshaft of the present invention, and FIGS. 5 and 6 are presented for further illustrating the oil-feeding holes of the present invention, in which a series of cams 22*a*–22*h* are provided at prescribed locations on the camshaft. Each of the chilled faces of the cams is provided with an oil-feeding hole 26. The diameter of the hole 26 may be adjusted depending on the diameter of the carbon rods employed. The opposites ends of the camshaft are provided with portions 30, 30 for receiving bearings (not shown). As is apparent from FIGS. 5 and 6, as-cast oil-feeding holes are provided on the chilled faces 22 of the cams 22.

EXAMPLES

FIG. 1 shows a cross section of the cam cavity of a first example in the form of a hollow chill casting mold for a camshaft. Upper chill 1 and lower chill 2 are both placed in a shell mold 3. 4 is a thin hole bored in the chill, into which carbon rod 5 is inserted. 6 is a shell center core.

FIG. 2 shows a cross section of another example of a hollow chill mold similar to the mold of FIG. 1. 7 is a chill, 8 is a center core, and 9 is a carbon rod.

FIG. 3 shows a cross section of an example of a solid casting mold for a camshaft, which does not use chills. 10 is a shell mold, 11 a core print hole, and 12 a carbon rod. The round carbon rod 12 in the mold projects into the cavity like a cantilever.

In examples using either one of the molds of FIGS. 1 through 3, a carbon rod 2 mm in diameter was enveloped in casting with the rod projecting to a depth of 10 mm into the casting. In the cases of FIGS. 1 and 2, the carbon rods were removed by heating them at 550° C. for 2 hours. In the case of FIG. 3, the resultant solid cast underwent axial boring along its center and the remaining portion of the enveloped carbon rod was mechanically removed after carrying out quenching.

In another example, a casting of a camshaft was made of ductile cast iron in a solid form without a chill. The casting was surface hardened by TIG remelting and underwent boring in the center. The enveloped carbon rods measuring 2 mm in diameter were removed by heating at 550° C. for 2 hours in an oxidizing atmosphere. The resultant camshaft had a hardness of Hv 900.

What is claimed:

1. A method for making a hollow camshaft made of cast iron having as-cast oil-feeding holes on the chilled faces of cam members comprising setting chills in cam-forming cavities, the chills having thin carbon rods disposed therein, placing a center core in the cavities to assemble a mold, executing casting using the mold to envelop the carbon rods, and then removing the carbon rods to leave as-cast oil-feeding holes.

2. A method for making a hollow camshaft as set forth in claim 1 wherein the carbon rods are removed mechanically.

3. A method for making a hollow camshaft as set forth in claim 2 wherein removing the carbon rods comprises drilling the carbon rods.

4. A method for making a hollow camshaft as set forth in claim 2 wherein removing the carbon rods comprises extruding the carbon rods.

5. A method for making a hollow camshaft as set forth in claim 1 wherein the carbon rods are removed by heating in an oxidizing atmosphere to burn the carbon rods.

6. A method for making a hollow camshaft as set forth in claim 1 wherein the cam-forming cavities are interconnected and the center core is disposed so as to extend between adjacent ones of the cavities.

7. A method for making hollow camshaft made of cast iron having as-cast oil-feeding holes on the chilled faces of cam members comprising inserting thin carbon rods into a center core, setting the center core in cam-forming cavities to assemble a mold, executing casting using the mold to envelop the carbon rods, and then removing the carbon rods to leave as-cast oil-feeding holes.

8. A method for making a hollow camshaft as set forth in claim 7 wherein the carbon rods are removed mechanically.

9. A method for making a hollow camshaft as set forth in claim 8 wherein removing the carbon rods comprises drilling the carbon rods.

10. A method for making a hollow camshaft as set forth in claim 8 wherein removing the carbon rods comprises extruding the carbon rods.

11. A method for making a hollow camshaft as set forth in claim 8 wherein the carbon rods are removed by heating in an oxidizing atmosphere to burn the carbon rods.

12. A method for making a hollow camshaft as set forth in claim 7 wherein the cam-forming cavities are interconnected and the center core is disposed so as to extend between adjacent ones of the cavities.

13. A method for making a hollow camshaft made of cast iron having as-cast oil-feeding holes on the chilled faces of cam members comprising inserting carbon rods through walls of cam forming cavities of a mold, executing casting using the mold to envelop the carbon rods to form a solid cast having cam members, axially boring the solid cast, surface-hardening the cam members, and then removing the enveloped carbon rods to leave oil-feeding holes.

14. A method for making a hollow camshaft as set forth in claim 13 wherein the carbon rods are removed mechanically.

15. A method for making a hollow camshaft as set forth in claim 14 wherein removing the carbon rods comprises drilling the carbon rods.

16. A method for making a hollow camshaft as set forth in claim 14 wherein removing the carbon rods comprises extruding the carbon rods.

17. A method making a hollow camshaft as set forth in claim 13 wherein the carbon rods are removed by heating in an oxidizing atmosphere to burn the carbon rods.

18. A method for making a hollow camshaft s set forth in claim 13 wherein the cam-forming cavities are interconnected, and axially boring is performed to interconnect the cam members.

* * * * *

UNITED STATES PATENT AND TRADEMARK OFFICE

CERTIFICATE OF CORRECTION

PATENT NO. : 5,450,665

DATED : September 19, 1995

INVENTOR(S) : Madono et al.

It is certified that error appears in the above-indentified patent and that said Letters Patent is hereby corrected as shown below:

Column 6, Line 1, after "making" insert --a--;

Line 44, after "method" insert --for--;

Line 48, change "s" to --as--.

Signed and Sealed this

Sixteenth Day of April, 1996

Bruce Lehman

BRUCE LEHMAN

*Commissioner of Patents and Trademarks*

*Attest:*

*Attesting Officer*